US011534803B2

(12) United States Patent
Pawlowski

(10) Patent No.: US 11,534,803 B2
(45) Date of Patent: Dec. 27, 2022

(54) ULTRASONIC WASHING CABINET

(71) Applicant: Cleaning Technologies Group LLC, Cincinnati, OH (US)

(72) Inventor: Gerard M. Pawlowski, Erie, PA (US)

(73) Assignee: Cleaning Technologies Group LLC, Cincinnati, OH (US)

( * ) Notice: Subject to any disclaimer, the term of this patent is extended or adjusted under 35 U.S.C. 154(b) by 746 days.

(21) Appl. No.: 16/564,977

(22) Filed: Sep. 9, 2019

(65) Prior Publication Data

US 2020/0078832 A1 Mar. 12, 2020

Related U.S. Application Data

(60) Provisional application No. 62/728,443, filed on Sep. 7, 2018.

(51) Int. Cl.

| | |
|---|---|
| ***B08B 3/12*** | (2006.01) |
| ***B08B 3/02*** | (2006.01) |
| ***C23G 3/00*** | (2006.01) |

(52) U.S. Cl.

CPC ..... *B08B 3/12* (2013.01); *B08B 3/02* (2013.01); *C23G 3/00* (2013.01); *B08B 2203/02* (2013.01)

(58) Field of Classification Search

None

See application file for complete search history.

(56) References Cited

U.S. PATENT DOCUMENTS

| | | | | |
|---|---|---|---|---|
| 4,741,351 | A | 5/1988 | Minkin | |
| 5,368,053 | A | 11/1994 | Wilson | |
| 5,482,065 | A | 1/1996 | O'Leary | |
| 5,501,240 | A * | 3/1996 | Dohku ..... | B08B 3/02 134/102.2 |

(Continued)

FOREIGN PATENT DOCUMENTS

JP 2006523521 A 10/2006

*Primary Examiner* — Mikhail Kornakov
*Assistant Examiner* — Pradhuman Parihar
(74) *Attorney, Agent, or Firm* — Phillips Lytle LLP; David L. Principe

(57) ABSTRACT

A washing cabinet for cleaning a part. The washing cabinet comprising: a sonication tank configured to contain a volume of liquid; at least one ultrasonic transducer configured to direct ultrasonic energy into the liquid in the sonication tank; a spray chamber disposed above the sonication tank; a spray system configured to direct liquid into the spray chamber; a part holder configured to support a part to be cleaned in the washing cabinet; a catch tray; an actuator system coupled to the part holder and the catch tray; the actuator system configured to move the part holder between an upper spray position in the spray chamber and a lower sonication position in the volume of liquid in the sonication tank; the actuator system configured to move the catch tray between a first tray position in the spray chamber and a second tray position; the catch tray positioned between the part holder and the sonication tank when the part holder is in the upper spray position and the catch tray is in the first tray position in the spray chamber; a liquid retaining tank separate from the sonication tank; and the catch tray having a tray outlet configured to direct liquid into the liquid retaining tank when the catch tray is in the first tray position in the spray chamber.

22 Claims, 14 Drawing Sheets

(56) References Cited

U.S. PATENT DOCUMENTS

| | | | | |
|---|---|---|---|---|
| 6,138,698 | A * | 10/2000 | Tanaka | H01L 21/67051 134/184 |
| 2008/0210276 | A1* | 9/2008 | Porter | B08B 3/02 134/198 |
| 2010/0043850 | A1* | 2/2010 | Kiener | B08B 3/12 134/184 |
| 2018/0001355 | A1* | 1/2018 | Shibata | B08B 3/102 |

* cited by examiner

ULTRASONIC WASHING CABINET

TECHNICAL FIELD

The present invention relates to a washing cabinet, and more particularly to washing cabinet having an upper spray chamber and a lower sonication chamber.

BACKGROUND ART

Ultrasonic technology may be used in a sonication machine to clean used parts. For example, assume a twelve transducer tank has 480 watts of ultrasonic power supplied in bursts every 8.3 milliseconds into a 12×12×8 inch volume of water (approximately 5 gallons). Each burst has 480 watts times 0.0083 seconds of energy, which equals approximately 4 joules of energy that are available to produce a cavitation. Next, assume the 4 joules of energy are converted into 1 microjoule implosions that occur at about the same time. This equates to approximately 4 million cavitation implosions occurring in the tank during the burst. Thereafter, the distance between each implosion is calculated in the 12×12×8 inch liquid volume. Let d=the spacing in inches, then along a 12 inch dimension, there is 12/d number of implosions. Along an 8 inch dimension, there will be 8/d number of implosions. The total number of implosions are 12/d times 12/d times 8/d, which equals 4,000,000. Solving for d gives a value of 0.066 inches. Converting to microns, this gives a value of 1677 microns. This is larger than the two micron radius sphere of influence one would expect from a one microjoule cavitation implosion. The volume occupied by 4 million, 2 micron radius spheres is 0.000000035399 gallons, which is a rather small amount of active area in a 5 gallon tank. Although the cavitation in this example affects a small volume of the cleaning liquid, ultrasonic tanks can still achieve high rates of cleanliness. This is because the ultrasonic waves traveling through the tank (liquid volume) reflect off the surface of highly acoustic impedance parts (e.g., metal parts) being cleaned in the tank. The ultrasonic displacement wave undergoes a 180 degree phase shift at this reflection, causing a displacement node that is located at the surface of the part being cleaned. Pressure anti-nodes are located at these displacement nodes. Pressure anti-nodes are where cavitations are created. Therefore, the cavitations are placed exactly where they are needed, at the surface of the parts being cleaned.

While cavitation takes place at the surface of the part being cleaned, sonication alone may not be able to flush away heavy accumulations of dirt and grime. Spray washing cleans contaminants from the outside to the inside, washing away heavy soil accumulation with a weighty flow of water. However, the spray cannot travel through solid accumulation as the ultrasound is able to do. Sonication can clean where spray is unable to reach and the energy of the cavitation bursts further loosens resistant soil. Ultrasound loosens dirt, making the spray wash more effective. Spray wash also removes heavy accumulations, opening up new areas for the ultrasound to attack and to remove dirt that is hidden from the spray wash because of the geometry of the part being cleaned.

As such, combining a spray wash with an ultrasound bath provides the most effective rapid, effective cleaning. Traditionally, a contaminated part being remanufactured or rebuilt is spray washed by a washing machine, removed from the washing machine, carried over to a sonication machine by an employee, and then sonicated by the sonication machine. An alternative process is for the part to be sonicated in a sonication machine, removed from the sonication machine, carried over to a washing machine by an employee, and then washed by a washing machine. These processes are labor and time intensive.

BRIEF SUMMARY

With parenthetical reference to corresponding parts, portions or surfaces of the disclosed embodiment, merely for the purposes of illustration and not by way of limitation, a washing cabinet (100) is provided comprising: a sonication tank (110) configured to contain a volume of liquid (115); at least one ultrasonic transducer (116) configured to direct ultrasonic energy into the liquid (115) in the sonication tank (110); a spray chamber (160) disposed above the sonication tank (110); a spray system (170) configured to direct liquid into the spray chamber (160); a part holder (130) configured to support a part to be cleaned in the washing cabinet (100); a catch tray (140); an actuator system (150) coupled to the part holder (130) and the catch tray (140); the actuator system (150) configured to move the part holder (130) between an upper spray position in the spray chamber (160) and a lower sonication position in the volume of liquid (115) in the sonication tank (110); the actuator system (150) configured to move the catch tray (140) between a first tray position in the spray chamber (160) and a second tray position; the catch tray (140) positioned between the part holder (130) and the sonication tank (110) when the part holder (130) is in the upper spray position and the catch tray (140) is in the first tray position in the spray chamber (160); a liquid retaining tank (118) separate from the sonication tank (110); and the catch tray (140) having a tray outlet (143) configured to direct liquid into the liquid retaining tank (118) when the catch tray (140) is in the first tray position in the spray chamber (160).

The sonication tank (110) may comprise a tank outlet configured to direct liquid into the liquid retaining tank (118). The liquid retaining tank (118) may be separated from the sonication tank (110) by a weir partition (117) and the tank outlet comprises an upper lip of the weir partition (117). The upper lip of the weir partition (117) may include a wave-like pattern to inhibit large items from falling into the liquid retaining tank (118). The liquid retaining tank (118) may be connected to the spray system (170) such that liquid in the liquid retaining tank (118) is selectively circulated through the spray system (1700). The washing cabinet (100) may further comprise a filter (172) between the liquid retaining tank (118) and the spray system (170). The sonication tank (110) may be connected to the spray system (170) such that liquid in the sonication tank (110) is selectively circulated through the spray system (170). The spray system (170) may comprise: a spray pump (171); a spray filter (172); at least one vertical spray bar (174); and at least one horizontal spray bar (175), the at least one vertical spray bar (174) and the at least one horizontal spray bar (175) being positioned in the spray chamber (160) and configured to spray wash the part supported by the part holder (130) when the part holder (130) is in the upper spray position in the spray chamber (160). Each of the at least one vertical spray bar (174) and the at least one horizontal spray bar (175) may comprise a plurality of spray nozzles (176). The plurality of spray nozzles (176) may be adjustable and directed to specific regions of the part being cleaned to maximize a surface area coverage of the spray wash. The at least one horizontal spray bar (175) may extend from the at least one vertical spray bar (174). The washing cabinet (100) may further comprise a control unit (180) configured to control the actuator system (150) and the spray system (170). The catch tray (140) may be coupled to the part holder (130) and the second tray position may be in the volume of liquid (115) in the sonication tank (110). The at least one ultrasonic transducer (116) may be positioned on an exterior surface of the sonication tank (110) of the washing cabinet (100). The at least one ultrasonic transducer (116) may be two ultrasonic transducers, the two ultrasonic transducers being positioned on opposite sides of the sonication tank (110) of the washing cabinet (100). The spray chamber (160) of the washing cabinet (100) may further comprise a positionable door (165) to access the spray chamber (160) of the washing cabinet (100). The positionable door (165) of the spray chamber (160) may horizontally reposition from a first position to a second position. The washing cabinet (100) may further comprise a rotating assembly (133) coupled to the part holder (130), the rotating assembly (133) being configured to rotate the part holder (130) so that the part being cleaned is thoroughly washed by the spray system (170). The part holder (130) may comprise a wire mesh to allow liquid to wash away from the part being cleaned. The catch tray (140) may comprise a larger surface area than a surface area of the part holder (130). The actuator system (150) may be at least one of an external pneumatic actuator and an electro-mechanical linkage mechanism. The actuator system (150) may be further configured to pulse the part being cleaned in at least one of the sonication tank (110) and the spray chamber (160).

DETAILED DESCRIPTION OF THE INVENTION

Figure 1:
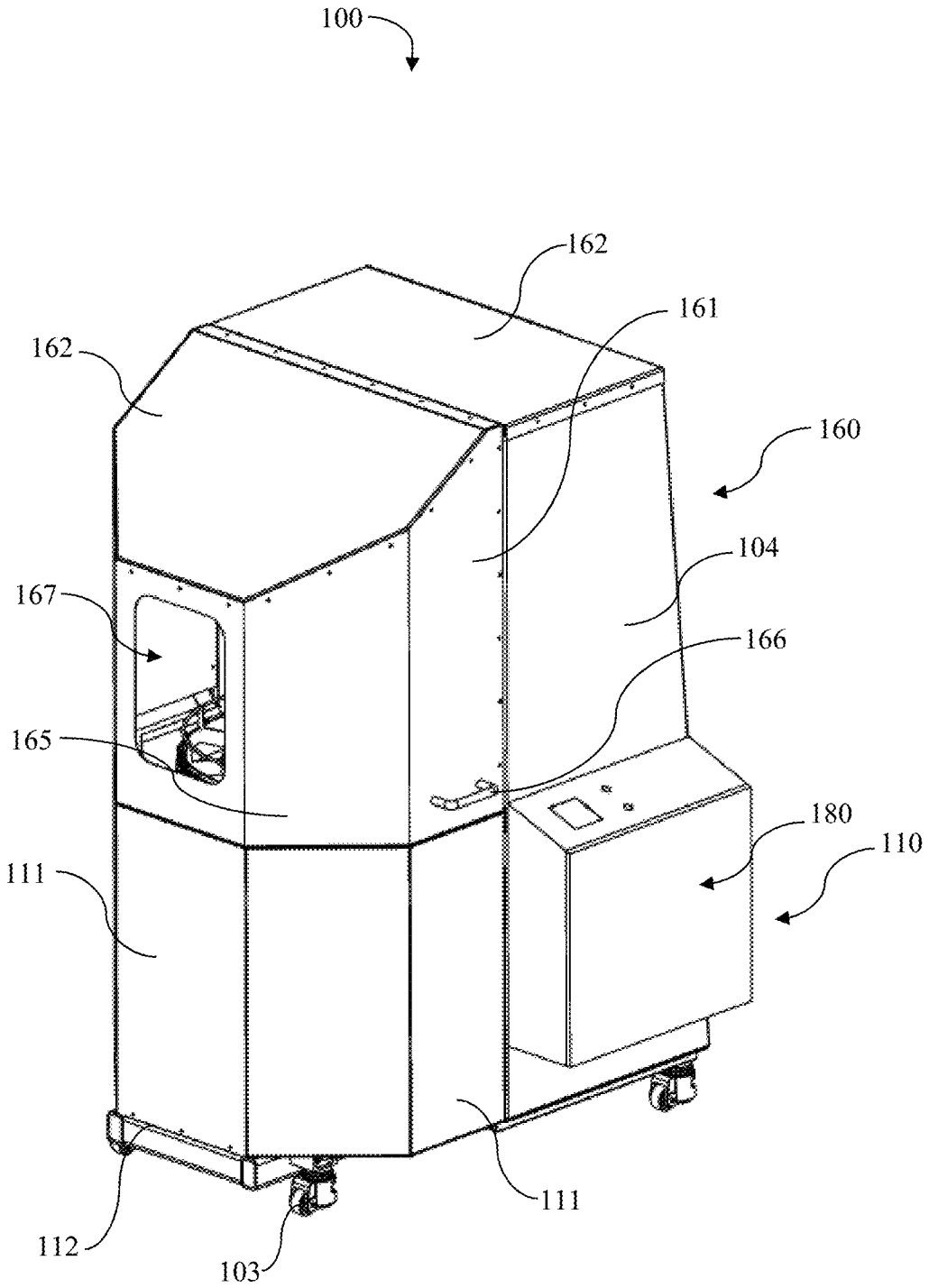
FIG. 1 is a perspective view of a first embodiment of a washing cabinet having an upper washing compartment, a carriage assembly, a spray assembly, and a lower sonication compartment.
Figure 2:
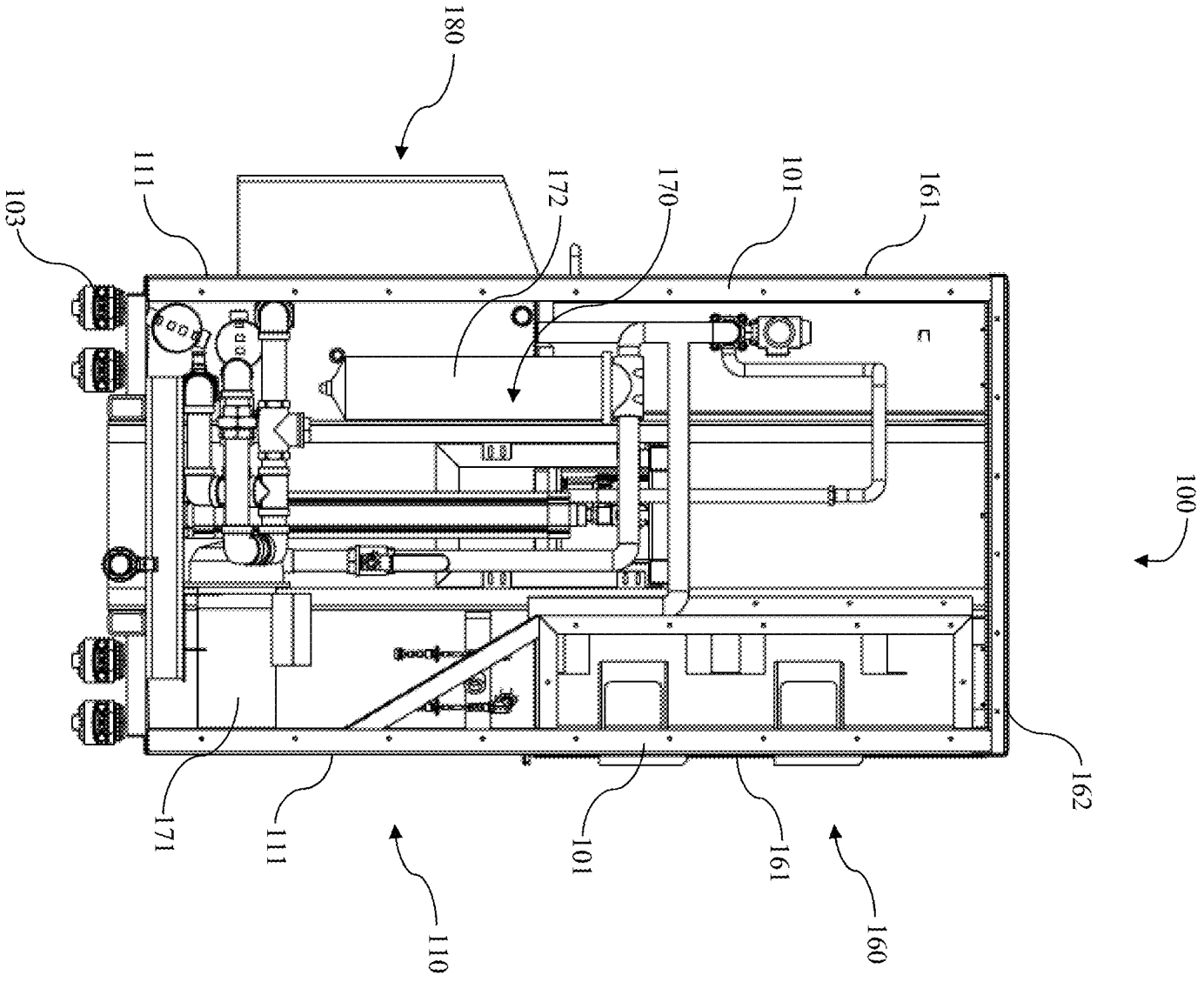
FIG. 2 is a rear elevated view of the washing cabinet of FIG. 1.
Figure 3:
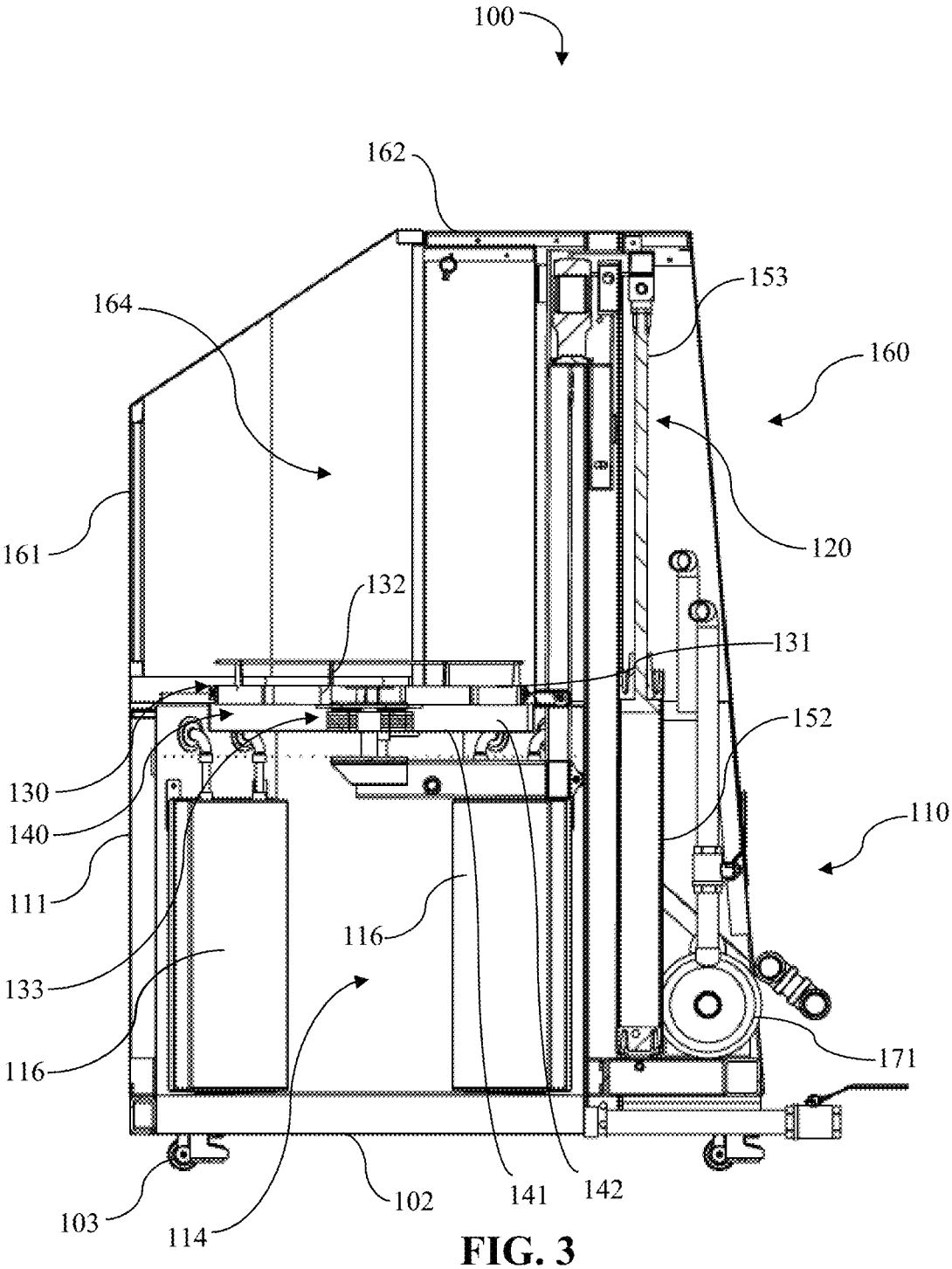
FIG. 3 is a side cross-sectional view of the washing cabinet of FIG. 1 with the carriage assembly positioned within the upper washing compartment.
Figure 4:
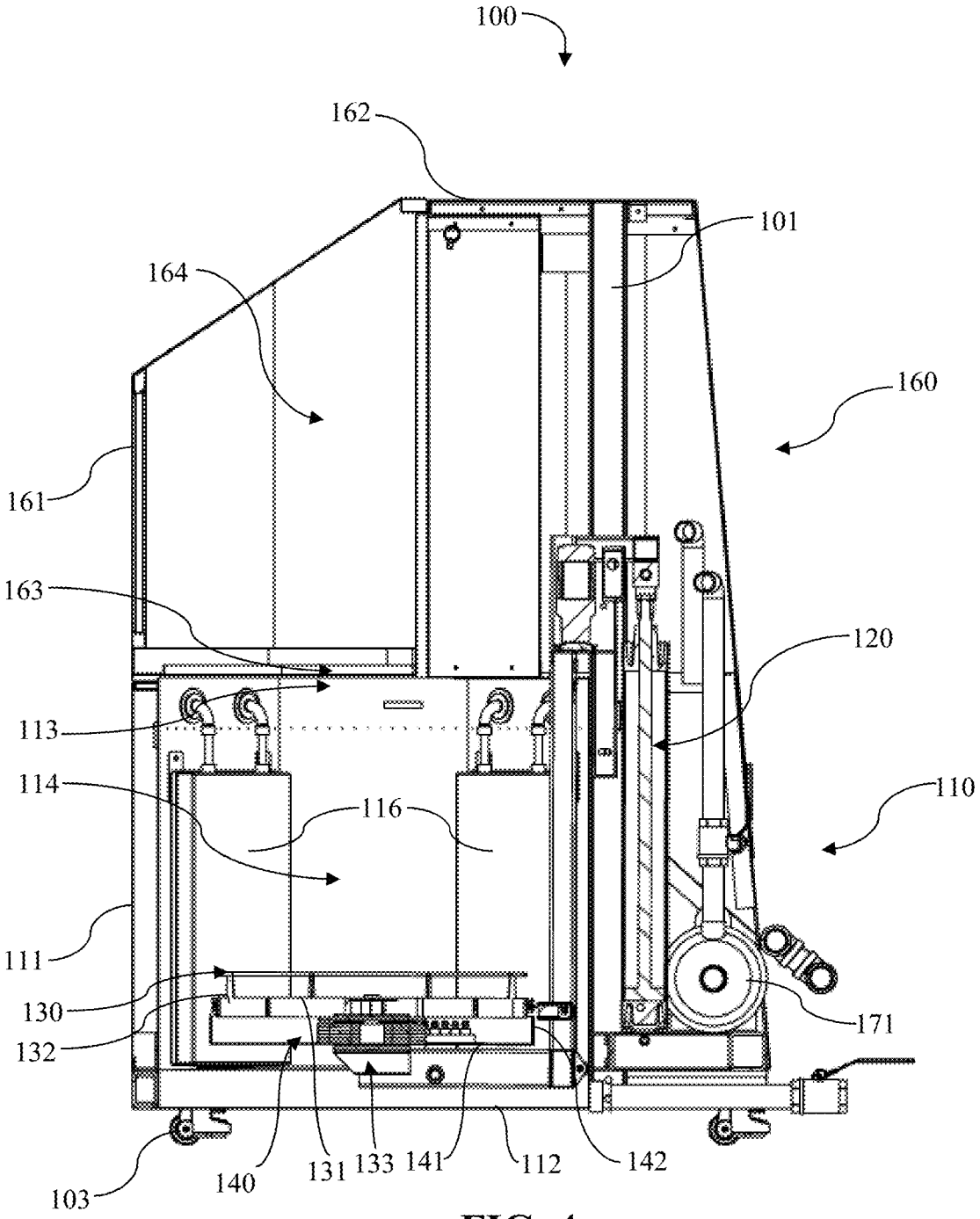
FIG. 4 is a side cross-sectional view of the washing cabinet of FIG. 1 with the carriage assembly positioned within the lower sonication compartment.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

The detailed description set forth below is intended as a description of various configurations of the disclosed embodiment(s) and is not intended to represent the only configurations in which the present disclosure may be practiced. It will be apparent, however, to those of ordinary skill in the art that the present disclosure is not limited to the specific details set forth herein and may be practiced without these specific details.

Referring now to the drawings, and more particularly to FIGS. 1-14 thereof, a washing cabinet is provided, of which a first embodiment is generally indicated at 100. The washing cabinet 100 is shown as broadly including a lower compartment 110, a carriage assembly 120, an upper compartment 160, a spray assembly 170, and a control unit 180. The washing cabinet 100 further includes a frame 101 to support the washing cabinet 100 and a skid 102 to more easily transport the washing cabinet 100. The skid 102 may include casters or wheels 103 to roll the washing cabinet 100 to a different location. The washing cabinet 100 may further include exterior panels 104 that encapsulate a portion of the lower compartment 110 and the upper compartment 160 of the washing cabinet 100.

Lower Compartment:

The lower compartment 110 includes a plurality of lower sides 111, a bottom portion 112, and an open top portion 113 that define a lower chamber 114 such as a bath. The plurality of lower sides 111 may form a polygonal shape such as a square, a hexagon, an octagon, and a circle. The lower compartment 110 is waterproof and stores a liquid 115 such as cleaning solution in the lower chamber 114 that can also be used for a sonication process and a cleaning process. The lower compartment 110 may be made of a carbon steel that is power coated or a stainless steel material. The lower chamber 114 of the lower compartment 110 may have a 60 gallon capacity.

The lower compartment 110 further includes at least one ultrasonic transducer 116 that is utilized for the sonication process. The ultrasonic transducer 116 may be a 3 kW sonication transducer (or similar) and positioned at various locations around the lower compartment 110 of the washing cabinet 100. For example, for an octagonal shaped lower compartment 110, the ultrasonic transducer 116 may be positioned at the corners or sides of the lower compartment 110 of the washing cabinet 100. Moreover, a first ultrasonic transducer 116 may be positioned opposite to a second ultrasonic transducer 116 to sonicate multiple sides of a part being cleaned at the same time. A plurality of ultrasonic transducers 116 is envisioned in the present embodiment. The shape of the lower compartment 110 of the washing cabinet 100 may also be determined by the number and position of the ultrasonic transducers 116.

The lower compartment 110 may further include a partition or weir 117 that creates a separate reservoir or chamber 118 to the lower chamber 114 of the lower compartment 110. The weir 117 may be a wall or sheet of material that connects to two different sides of the lower compartment 110 and the bottom portion 112 of the lower compartment 110, while a top portion of the weir 117 may be higher than a top level of the cleaning solution 115 in the lower chamber 114 of the lower compartment 110 to prevent the cleaning solution 115 from flowing into the overflow chamber 118 formed by the weir 117. The top portion or lip of the weir 117 may curved, bent, or include a wave-like pattern such as a square wave pattern to inhibit large items from falling into the overflow chamber 118. The weir overflow chamber 118 may also include an oil removal system (e.g. a belt skimmer) to further remove contaminates from the washing cabinet 100.

Figure 12:
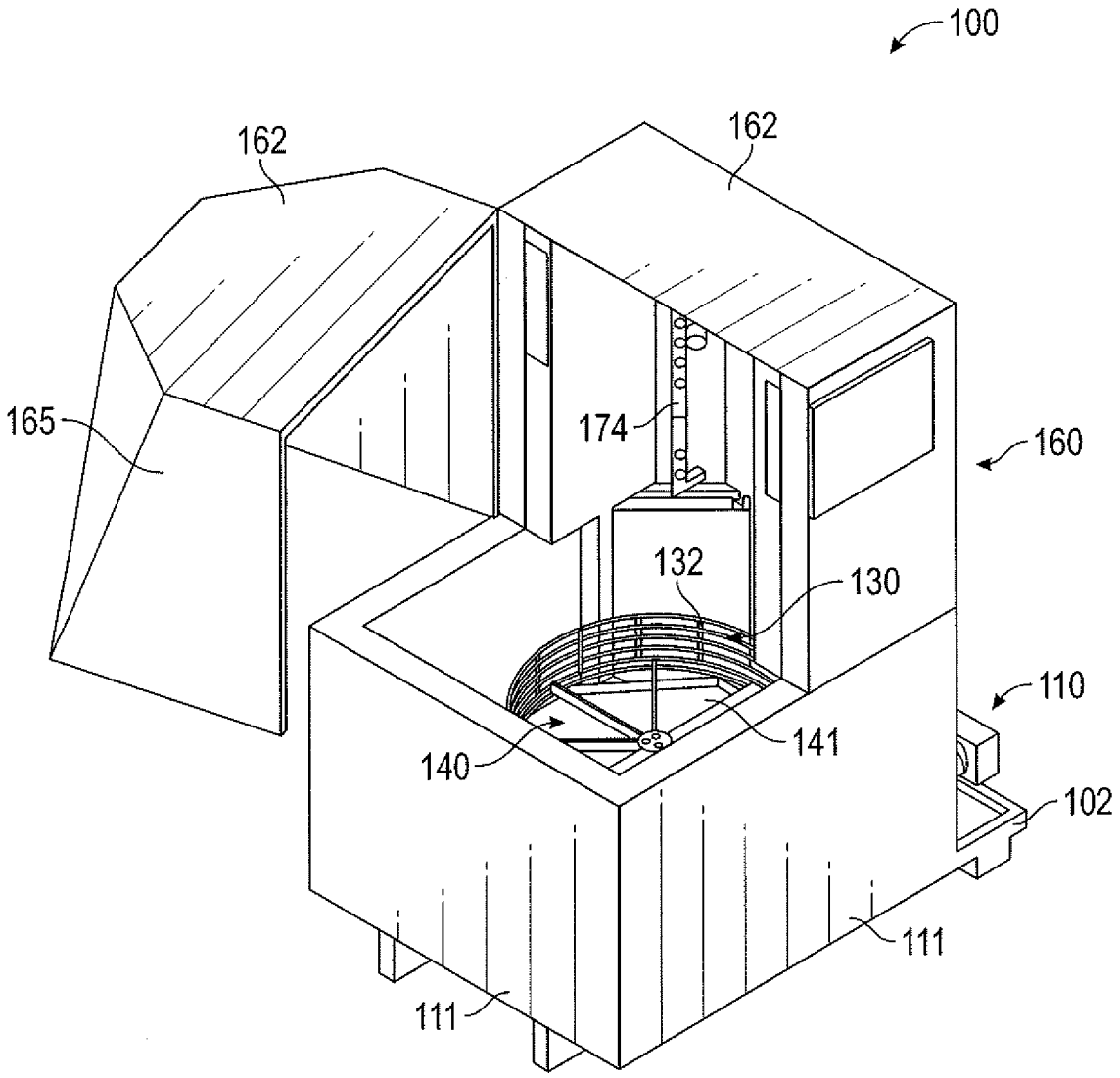
FIG. 12 is perspective view of a second embodiment of a washing cabinet with an upper washing compartment having a swinging door, a carriage assembly, a spray assembly, and a lower sonication compartment.

Upper Compartment:

The upper compartment 160 includes a plurality of upper sides 161, a top portion 162, and an open bottom portion 163 that define an upper chamber 164. The plurality of upper sides 161 may form a polygonal shape such as a square, a hexagon, an octagon, and a circle. The upper compartment 160 may be made of a carbon steel that is power coated or a stainless steel material. The upper compartment 160 may further include an upper door 165 that allows a user to access the upper chamber 164 of the upper compartment 160 as shown in FIG. 12. The upper door 165 may open sideward or upwardly and includes a door handle 166 to more easily open the upper door 165. The upper door 165 may be connected to the upper compartment 160 by hinges. The upper door 165 may also include a viewing window 167 to readily see the part that is being cleaned in the upper chamber 164 of the upper compartment 160.

Carriage Assembly:

The carriage assembly 120 includes a part holder 130, a catch tray 140, and an actuator 150. The part holder 130 of the carriage assembly 120 includes a bottom part holder portion 131 and a plurality of side walls 132. The bottom part holder portion 131 and the plurality of side walls 132 of the part holder 130 may be a wire or mesh design to allow the cleaning solution 115 to wash away from the part being cleaned. The cleaning solution 115 being sprayed by the spray assembly 170 may be detergent, soap, acid, water, tap water, distilled water, or any other fluid suitable for the intended purpose and understood by a person of ordinary skill in the art.

The part holder 130 may further include a rotating assembly 133 that rotates the part holder 130 so that the part being cleaned is sprayed by the spray assembly 170 by 360 degrees. The rotating assembly 133 may be a friction drive revolving table. The rotating assembly 133 can be, for example, a 24 inch diameter turntable.

The catch tray 140 of the carriage assembly 120 may include a bottom catch tray portion 141, a plurality of side flaps 142, and a catch tray outlet 143 that collects the cleaning solution 115 being sprayed by the spray assembly 170. The catch tray 140 is positioned under the part holder 130 to capture much of the cleaning solution 115 that is sprayed from the spray assembly 170. As the cleaning solution 115 is sprayed from the spray assembly 170 onto the part being cleaned, the cleaning solution 115 becomes contaminated. To keep the contaminated cleaning solution from falling back into the cleaning solution 115 in the lower chamber 114 of the lower compartment 110, the catch tray 140 diverts the contaminated cleaning solution through the catch tray outlet 143 over the weir overflow 117 into holding chamber 118. The weir overflow 117 and holding chamber 118 then directs the contaminated cleaning solution to the spray assembly 170 where the contaminated cleaning solution is then filtered and recycled for use by the washing cabinet 100.

The bottom catch tray portion 141 may be a single sheet of sheet metal or plastic that is configured to capture the majority of the contaminated cleaning solution. The catch tray 140 may also be configured to have a top cross-sectional surface area that is less than a top cross-sectional surface area of the lower chamber 114 of the lower compartment 110 to allow the bottom catch tray portion 141 to be repositioned between the top and bottom of the lower chamber 114 of the lower compartment 110 without contacting another component of the washing cabinet 100, so as not to damage the washing cabinet 100.

Figure 11:
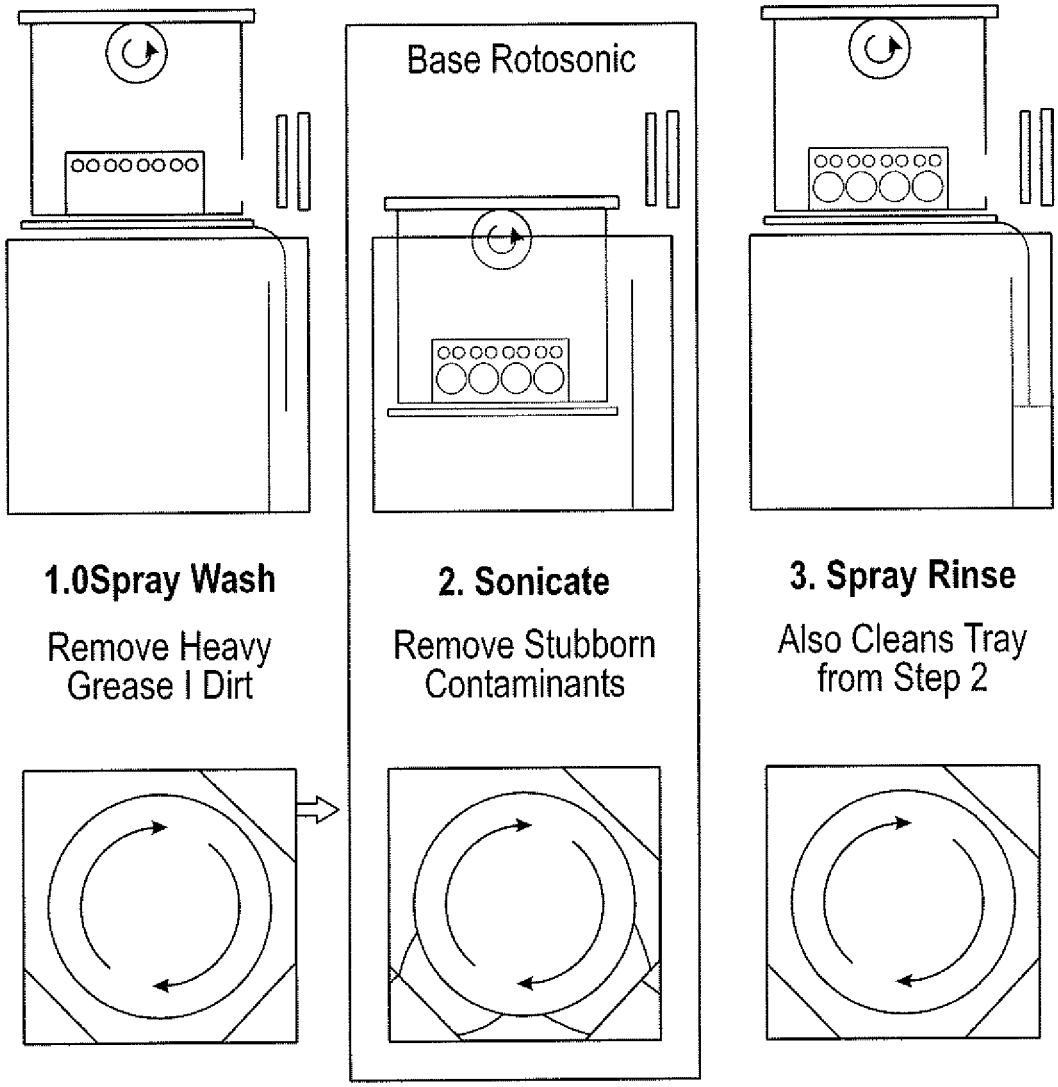
FIG. 11 is a diagram of a process of utilizing the washing cabinet of FIG. 1.

The actuator 150 includes a piston, a tube 152 housing the piston, and an actuator arm 153 to reposition the part holder 130 and the catch tray 140 between the lower chamber 114 of the lower compartment 110 and the upper chamber 164 of the upper compartment 160. As shown in FIG. 11, step 1 includes spray washing the part to be cleaned in the upper chamber 164 of the upper compartment 160 with the spray assembly 170 to remove heavy grease or dirt. In step 2, the part to be cleaned is lowered into the cleaning solution 115 in the lower chamber 114 of the lower compartment 110 to be sonicated by the ultrasonic transducer 116, thereby removing further contaminants from the part being cleaned. In step 3, the part being cleaned is raised up into the upper chamber 164 of the upper compartment 160 and then spray washed again by the spray assembly 170 to further clean the part, the part holder 130, and the catch tray 140.

Figure 13:
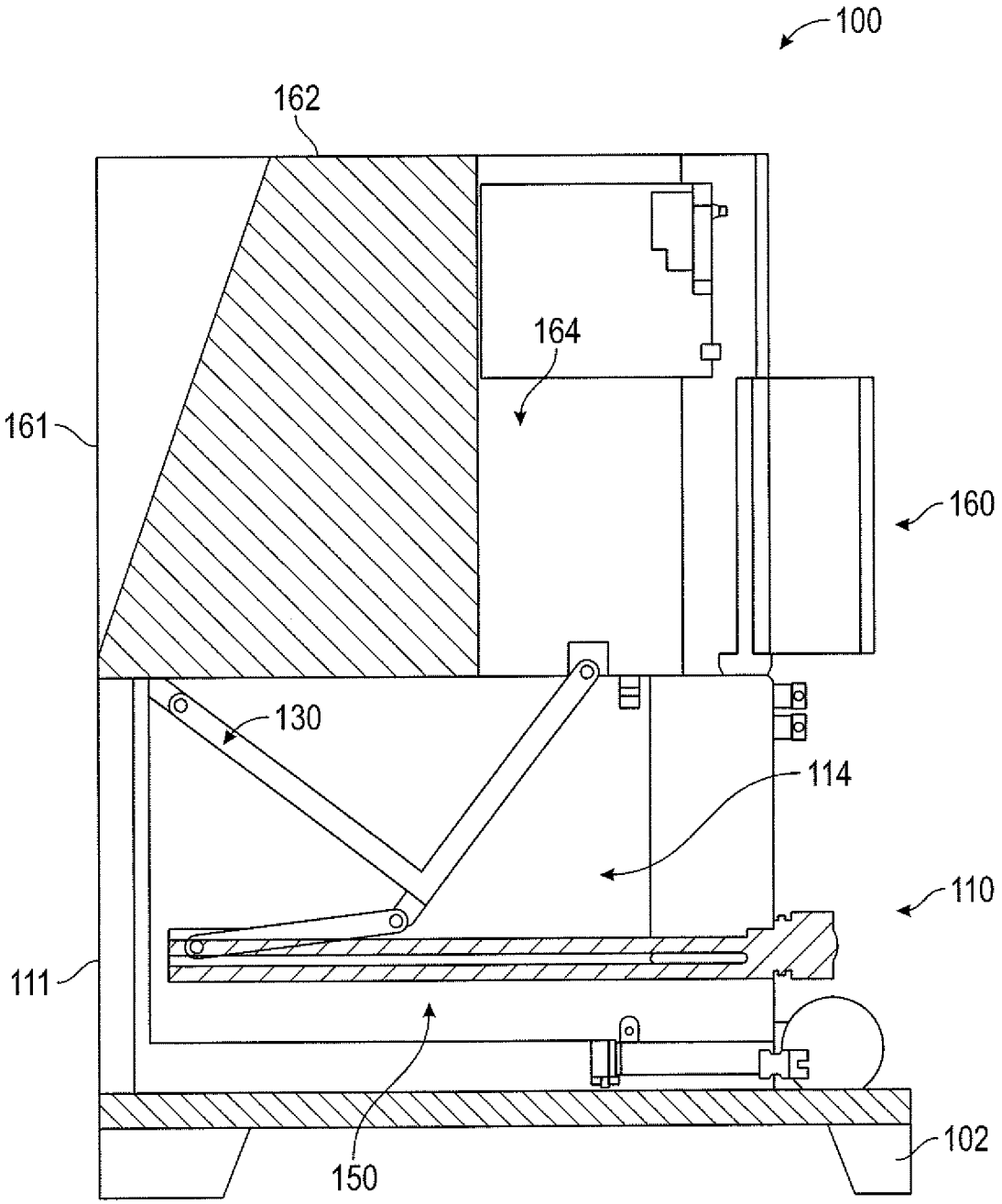
FIG. 13 is a side cross-sectional view of the washing cabinet of FIG. 12 having an electromechanical mechanism positioned in the lower sonication compartment such that the carriage assembly is in lower sonication compartment.
Figure 14:
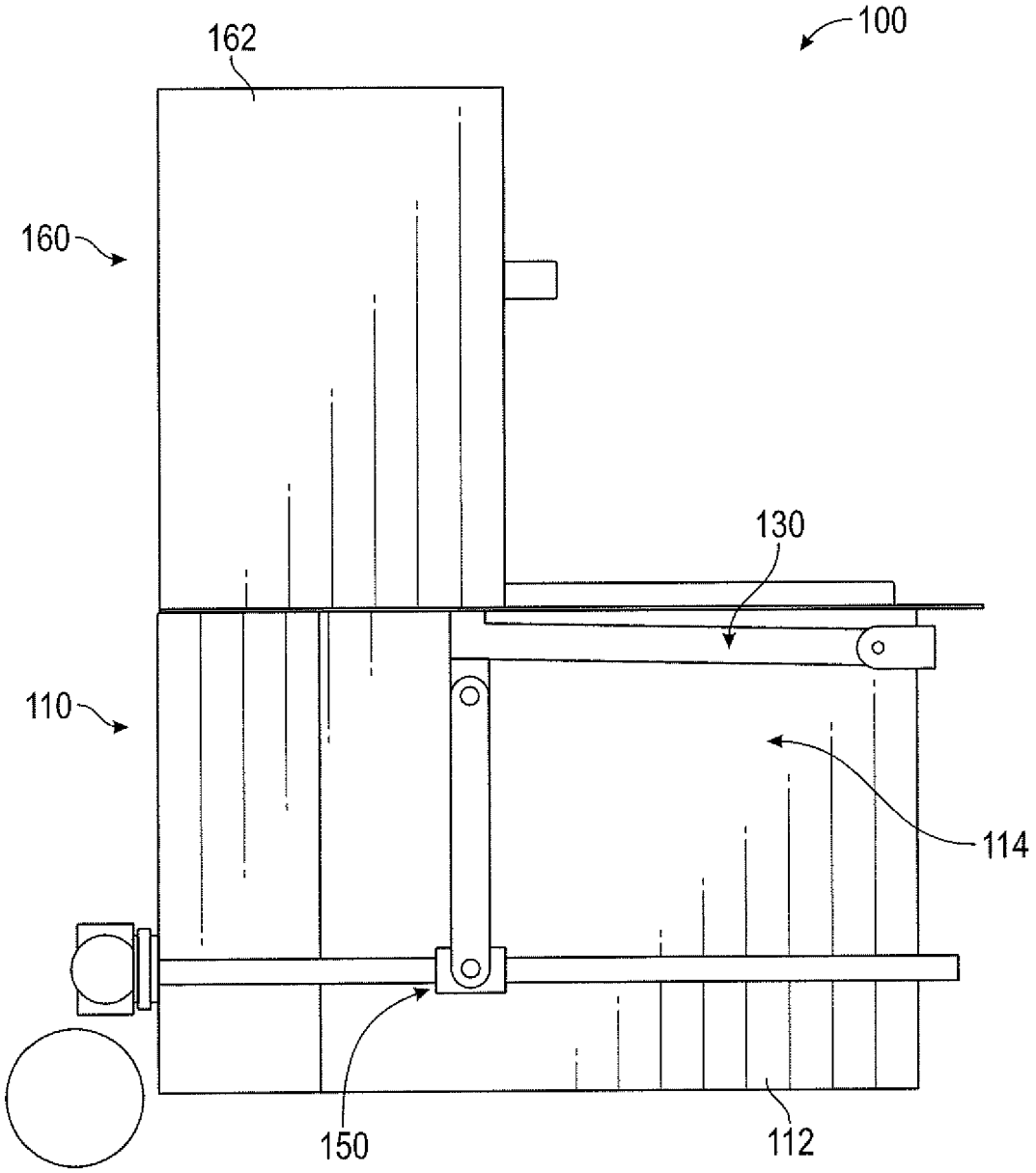
FIG. 14 is a side cross-sectional view of the washing cabinet of FIG. 12 with the electromechanical mechanism positioned in the upper washing compartment such that the carriage assembly is in the upper washing compartment.

The actuator 150 may also pulse the part holder 130 and the catch tray 140 in the lower chamber 114 of the lower compartment 110 to enhance the sonication process and in the upper chamber 164 of the upper compartment 160 to shake off contaminate material and washing fluid from the part being cleaned. The actuator 150 may be electromechanical (as shown in FIGS. 13 and 14), manual, pneumatic, hydraulic, electrical, spring driven, motor driven, or any other type of actuator suitable for the intended purpose and understood by a person of ordinary skill in the art. Air systems may take up to 8 HP at an electrical outlet and produce approximately 1 HP at the point of usage.

An electromechanical actuator (as shown in FIGS. 13 and 14) may save energy and increase safety. The part being cleaned is also supported in the event of a power failure. The electromechanical linkage actuator also simplifies adjustment, reduces wear points, and reduces the need for special components and custom materials by removing most of the part being cleaned from the fluid bath. The electromechanical actuator is configured to move forward to ease loading and unloading of parts to be cleaned and place outfall from the spray wash directly over the weir overflow partition 117 and chamber 118, where the part being cleaned may easily be screened of large contaminants and handled separately from rinse water. A toggle mechanism may also provide direct steel support of heavy loads when the part holder 130 and the catch tray 140 are in a raised position, i.e., outside of the cleaning solution 115 bath.

FIGS. 13 and 14 illustrate an L-shaped arm electromechanical actuator. The L-shaped arm allows maximum clearance for part loading when the part holder 130 and the catch tray 140 are raised from the lower chamber 114 of the lower compartment 110. FIG. 13 illustrates the electromechanical actuator in a lower position, with the part holder 130 and the catch tray 140 immersed in the cleaning solution 115 bath in the lower chamber 114 of the lower compartment 110. FIG. 14 illustrates the electromechanical actuator in an upper position, with the part holder 130 and the catch tray 140 outside of the cleaning solution 115 bath of the lower chamber 114 of the lower compartment 110, thereby positioning the part being cleaned in the upper chamber 164 of the upper compartment 160 to be spray washed by the spray assembly 170 of the washing cabinet 100.

Figure 5:
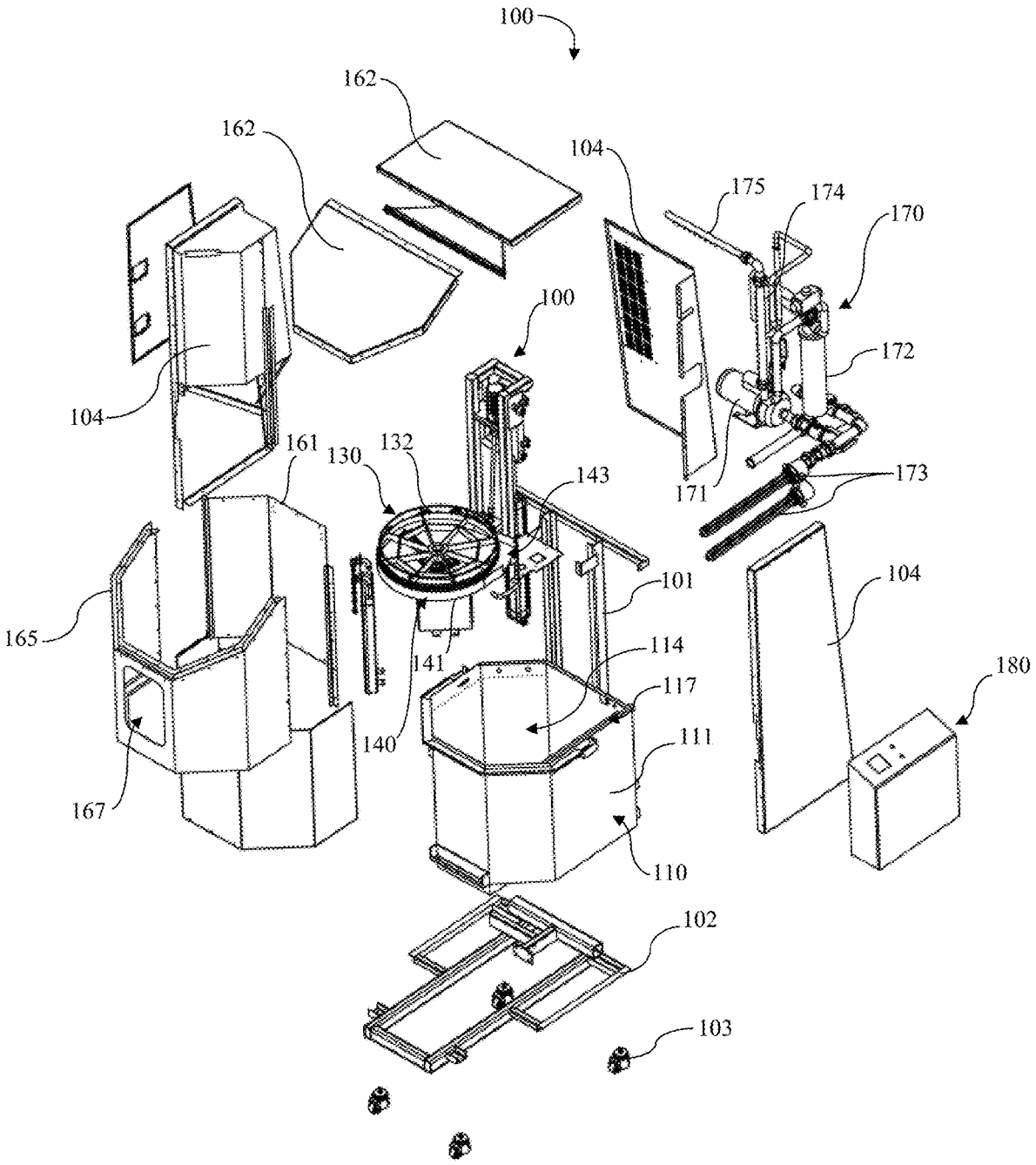
FIG. 5 is an exploded perspective view of the washing cabinet of FIG. 1.
Figure 6:
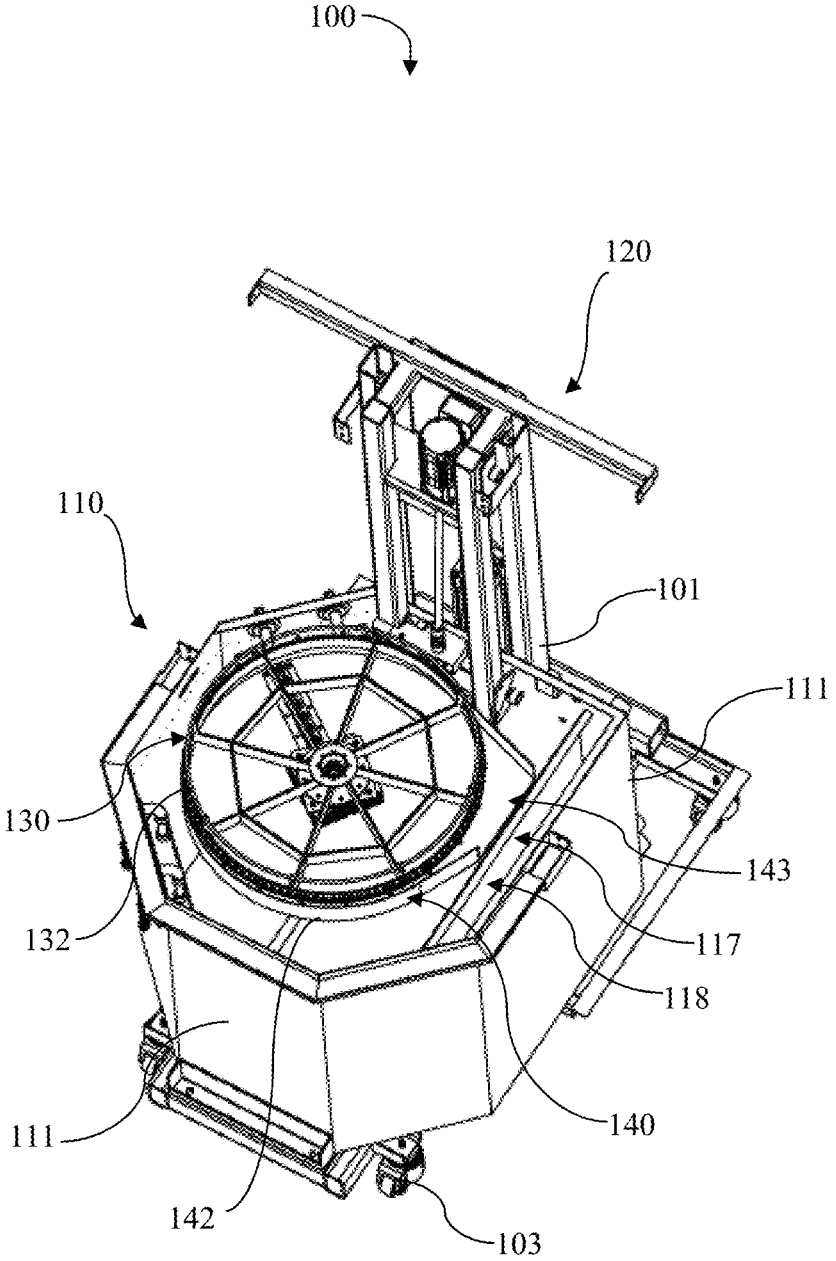
FIG. 6 is a top perspective view of the washing cabinet of FIG. 1 without the upper washing compartment.
Figure 7:
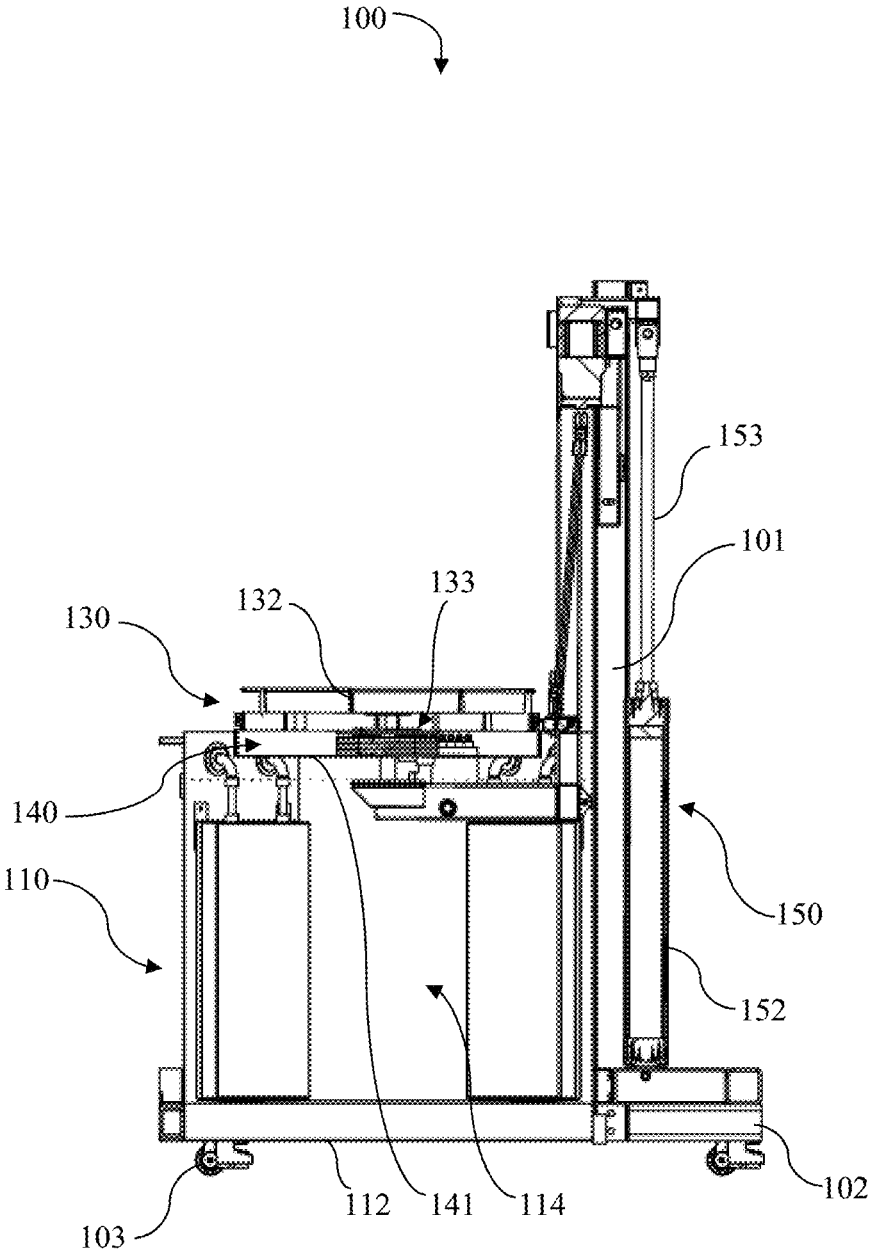
FIG. 7 is a side elevated view of the washing cabinet of FIG. 1 without the upper washing compartment.
Figure 8:
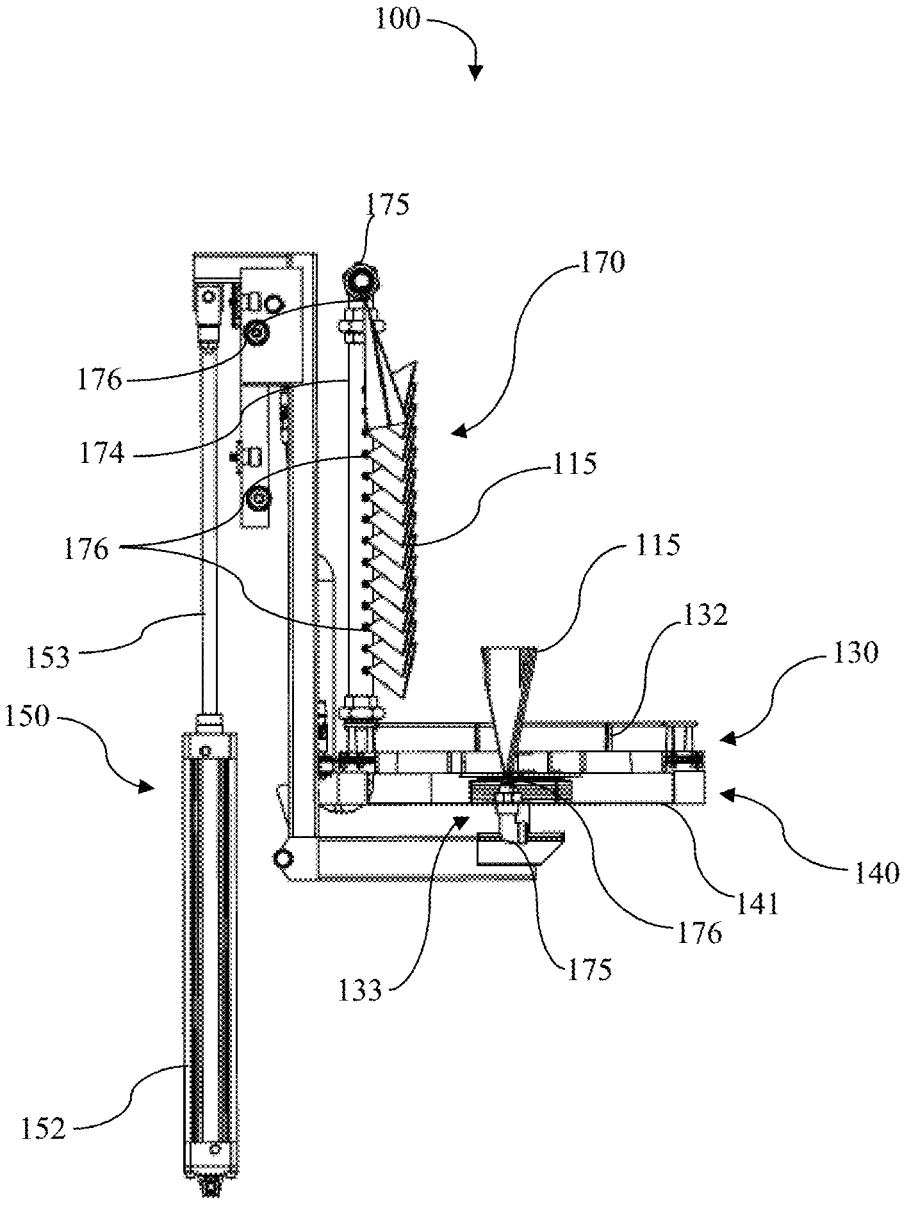
FIG. 8 is a side elevated view of the spray assembly and the carriage assembly of the washing cabinet of FIG. 1.
Figure 9:
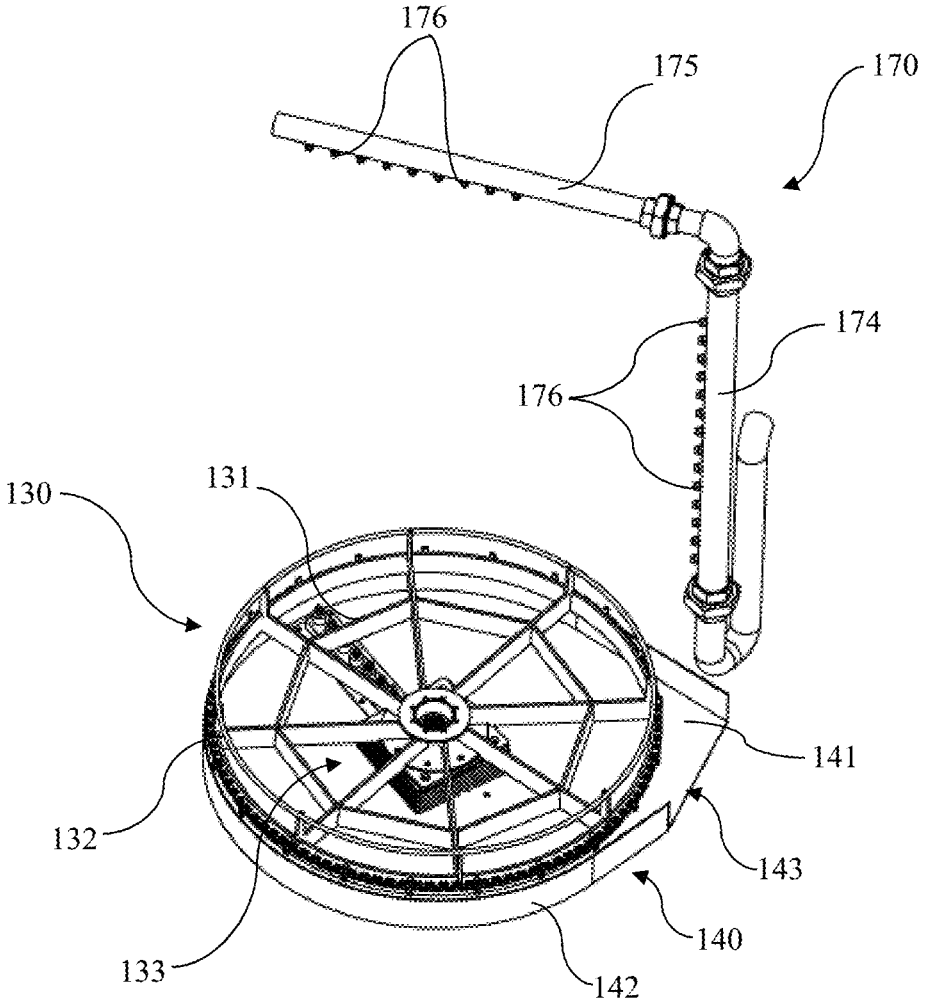
FIG. 9 is a top perspective view of the spray assembly and the carriage assembly of the washing cabinet of FIG. 1.
Figure 10:
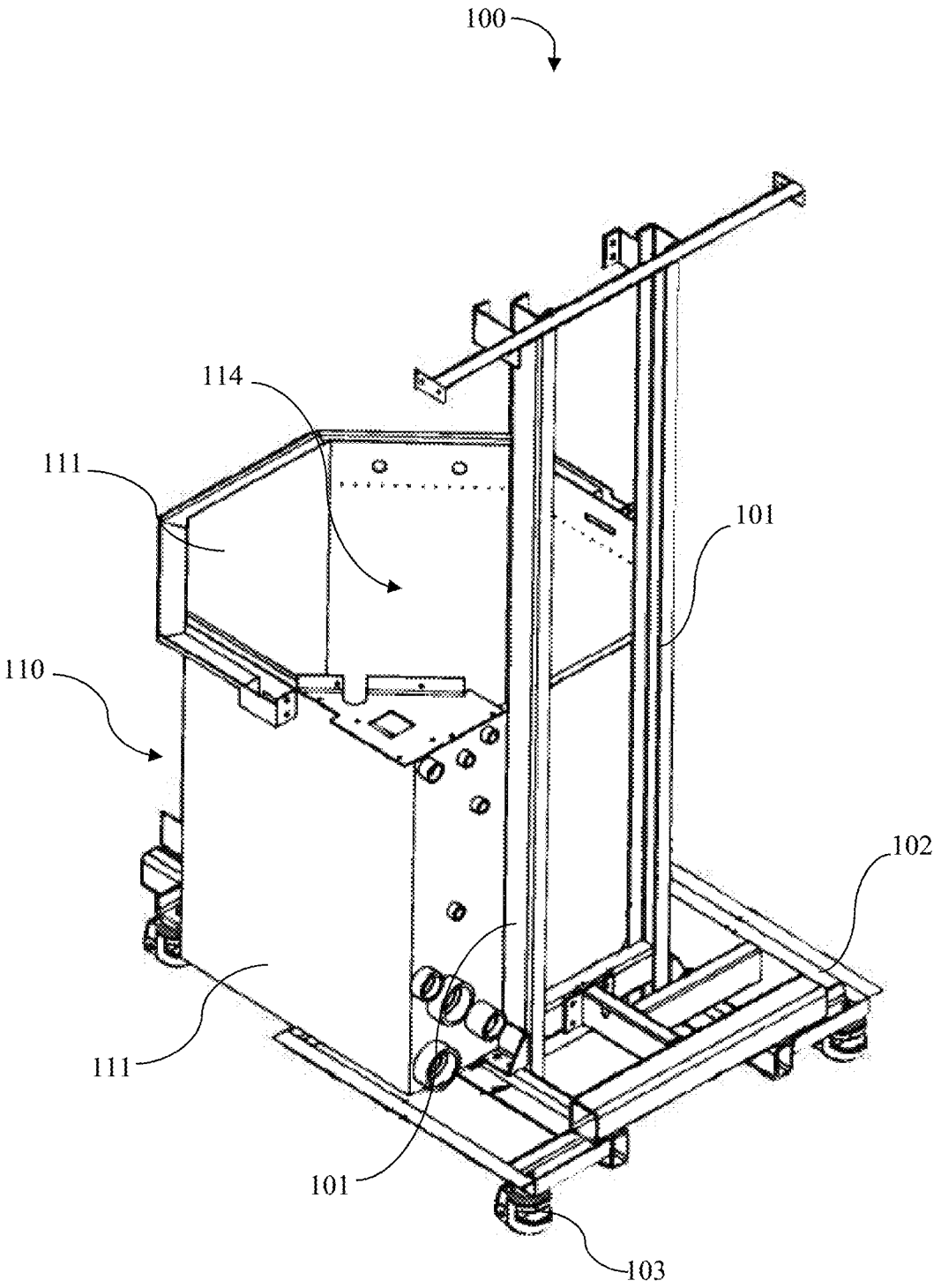
FIG. 10 is a perspective view of the lower sonication compartment of the washing cabinet of FIG. 1 without the upper washing compartment, the carriage assembly, and the spray assembly.

Spray Assembly:

As shown in FIGS. 5, 8, and 9, the spray assembly 170 includes a spray pump 171, a spray filter 172, an end pipe filter 173, a vertical spray bar 174, and a horizontal spray bar 175, each of the vertical spray bar 174 and the horizontal spray bar 175 having a plurality of spray nozzles 176. The spray pump 171, spray filter 172, end pipe filter 173, vertical spray bar 174, and horizontal spray bar 175 are interconnected with pipes to facilitate the flow of the cleaning solution 115 and the rinsing fluid. The spray pump 171 forces the contaminated cleaning solution or rinsing fluid through the spray assembly 170, which may be reused by the washing cabinet 100. The spray pump 171 may be a centrifugal pump (3 HP, 70 GPM), a hydraulic pump, a plunger pump, a Gould pump, or any other pump suitable for the intended purpose and understood by a person of ordinary skill in the art. The spray wash of the spray pump 171 may be at approximately 30-80 PSI.

The contaminated cleaning solution or rinsing fluid is initially drawn through and filtered by the end pipe filter 173, e.g., a bag filter. The pre-filtered contaminated cleaning solution or rinsing fluid is then forced to the spray filter 172 for further filtration and preparation for reuse by the washing cabinet 100. After the contaminated cleaning solution or rinsing fluid is completely filtered, the post-filtered cleaning solution or rinsing fluid is ejected out of the plurality of spray nozzles 176 of the vertical spray bar 174 and the horizontal spray bar 175.

The spray assembly 170 is configured to spray the cleaning solution 115 from the bath in the lower chamber 114 of the lower compartment 110, or to use cleaning solution 115 from the overflow chamber 118 of the lower compartment 110, or a combination of both, or cleaning solution from a separate container, or water or any other rinsing fluid from a separate container, to clean the subject part. Where the fluid is drawn from may depend on what stage in the washing process the subject part is in.

The vertical spray bar 174 is shown in a vertical position, but alternatively may be circumferentially angled to maximize the surface area being cleaned on the part in the part holder 130. The plurality of spray nozzles 176 of the vertical spray bar 174 is directed towards the center of the part holder 130, but may alternatively be positioned to direct the cleaning solution 115 to a different portion of the part holder 130, depending on the shape of the part being cleaned. The plurality of spray nozzles 176 of the vertical spray bar 174 may also project the cleaning solution 115 at a perpendicular angle with respect to a longitudinal axis of the vertical spray bar 174.

The horizontal spray bar 175 is shown in a horizontal position directly above the part holder 130, but may alternatively be angled off-center to maximize the surface area being cleaned on the part in the part holder 130. The plurality of spray nozzles 176 of the horizontal spray bar 175 is directed towards the center of the part holder 130, but may alternatively be positioned to direct the cleaning solution 115 to a different portion of the part holder 130, depending on the shape of the part being cleaned. The plurality of spray nozzles 176 of the horizontal spray bar 175 may also project the cleaning solution 115 at a perpendicular angle with respect to a longitudinal axis of the horizontal spray bar 175.

The vertical spray bar 174 and the horizontal spray bar 175 may be connected and a part of the same pipe line as shown in FIG. 9, but in an alternative embodiment, the vertical spray bar 174 and the horizontal spray bar 175 may be separate pipe lines. For example, the vertical spray bar 174 may be at one side of the washing cabinet 100, while the horizontal spray bar 175 is at the opposite side of the washing cabinet 100.

The spray assembly 170 may further comprise a heat exchanger to heat the cleaning solution 115 and the rinsing fluid to spray wash the contaminated part or article with a heated cleaning solution/ringing fluid, which may contribute to removing the contaminates from the article in a more efficient manner.

Control Unit:

The control unit 180 of the washing cabinet 100 controls the carriage assembly 120 and the spray assembly 170. The control unit 180 includes a processor and memory that stores instructions to facilitate operation of the washing cabinet 100. For example, the control unit 180 controls the carriage assembly 120 to either position the part holder 130 and the catch tray 140 in the lower chamber 114 of the lower compartment 110 to be sonicated by the ultrasonic transducer 116 or in the upper chamber 164 of the upper compartment 160 to be spray washed by the spray assembly 170. The control unit 180 is also configured to pulse the part holder 130 and the catch tray 140 in the lower chamber 114 of the lower compartment 110 to enhance the sonication process and in the upper chamber 164 of the upper compartment 160 to shake off contaminate material and rinsing fluid from the part being cleaned.

The control unit 180 also controls the spray assembly 170 to spray wash the part to be cleaned in the upper chamber 164 of the upper compartment 160. The control unit 180 may be configured to control the flow rate of the spray wash from the vertical spray bar 174 and the horizontal spray bar 175. For example, for a part that is highly contaminated with dirt and grime, the control unit 180 may increase the flow rate of the spray wash from the vertical spray bar 174 and the horizontal spray bar 175 to remove as much contaminate as possible prior to the sonication process. In the alternative embodiment where the vertical spray bar 174 and the horizontal spray bar 175 do not share the same pipe from which the cleaning solution 115 and the rinsing fluid is received, the control unit 180 may be configured to spray wash from only one of the spray bars at a given time. In this alternative embodiment, the control unit 180 may also be configured to alternate the spray wash from the vertical spray bar 174 to the horizontal spray bar 175 and vice versa.

It is appreciated that certain features of the disclosure, which are, for clarity, described in the context of separate embodiments, may also be provided in combination in a single embodiment. Conversely, various features of the disclosure, which are, for brevity, described in the context of a single embodiment, may also be provided separately or in any suitable subcombination.

The present disclosure contemplates that many changes and modifications may be made. Therefore, while forms of the improved washing cabinet have been shown and described, and a number of alternatives discussed, persons skilled in this art will readily appreciate that various additional changes and modifications may be made without departing from the scope of the invention, as defined and differentiated by the following claims.

What is claimed is:

1. A washing cabinet for cleaning a part, said washing cabinet comprising:

a sonication tank configured to contain a volume of liquid;

at least one ultrasonic transducer configured to direct ultrasonic energy into said liquid in said sonication tank;

a spray chamber disposed above said sonication tank;

a spray system configured to direct said liquid into said spray chamber;

a part holder configured to support a part to be cleaned in said washing cabinet;

a catch tray;

an actuator system coupled to said part holder and said catch tray;

said actuator system configured to move said part holder between an upper spray position in said spray chamber and a lower sonication position in said volume of liquid in said sonication tank;

said actuator system configured to move said catch tray between a first tray position in said spray chamber and a second tray position;

said catch tray positioned between said part holder and said sonication tank when said part holder is in said upper spray position and said catch tray is in said first tray position in said spray chamber;

a liquid retaining tank separate from said sonication tank; and said catch tray having a tray outlet configured to direct liquid into said liquid retaining tank when said catch tray is in said first tray position in said spray chamber.

2. The washing cabinet of claim 1, wherein said sonication tank comprises a tank outlet configured to direct said liquid into said liquid retaining tank.

3. The washing cabinet of claim 2, wherein said liquid retaining tank is separated from said sonication tank by a weir partition and said tank outlet comprises an upper lip of said weir partition.

4. The washing cabinet of claim 3, wherein said upper lip of said weir partition includes a wave-like pattern to inhibit large items from falling into said liquid retaining tank.

5. The washing cabinet of claim 1, wherein said liquid retaining tank is connected to said spray system such that liquid in said liquid retaining tank is selectively circulated through said spray system.

6. The washing cabinet of claim 5, further comprising a filter between said liquid retaining tank and said spray system.

7. The washing cabinet of claim 1, wherein said sonication tank is connected to said spray system such that liquid in said sonication tank is selectively circulated through said spray system.

8. The washing cabinet of claim 1, wherein said spray system comprises:

a spray pump;

a spray filter;

at least one vertical spray bar; and at least one horizontal spray bar, said at least one vertical spray bar and said at least one horizontal spray bar being positioned in said spray chamber and configured to spray wash said part supported by said part holder when said part holder is in said upper spray position in said spray chamber.

9. The washing cabinet of claim 8, wherein each of said at least one vertical spray bar and said at least one horizontal spray bar comprises a plurality of spray nozzles.

10. The washing cabinet of claim 9, wherein said plurality of spray nozzles are adjustable and directed to specific regions of said part being cleaned to maximize a surface area coverage of said spray wash.

11. The washing cabinet of claim 8, wherein said at least one horizontal spray bar extends from said at least one vertical spray bar.

12. The washing cabinet of claim 1, further comprising a control unit configured to control said actuator system and said spray system.

13. The washing cabinet of claim 1, wherein said catch tray is coupled to said part holder and said second tray position is in said volume of liquid in said sonication tank.

14. The washing cabinet of claim 1, wherein said at least one ultrasonic transducer is positioned on an exterior surface of said sonication tank of said washing cabinet.

15. The washing cabinet of claim 1, wherein said at least one ultrasonic transducer is two ultrasonic transducers, said two ultrasonic transducers being positioned on opposite sides of said sonication tank of said washing cabinet.

16. The washing cabinet of claim 1, wherein said spray chamber of said washing cabinet further comprises a positionable door to access said spray chamber of said washing cabinet.

17. The washing cabinet of claim 16, wherein said positionable door of said spray chamber horizontally repositions from a first position to a second position.

18. The washing cabinet of claim 1, further comprising a rotating assembly coupled to said part holder, said rotating assembly being configured to rotate said part holder so that said part being cleaned is thoroughly washed by said spray system.

19. The washing cabinet of claim 1, wherein said part holder comprises a wire mesh to allow liquid to wash away from said part being cleaned.

20. The washing cabinet of claim 1, wherein said catch tray comprises a larger surface area than a surface area of said part holder.

21. The washing cabinet of claim 1, wherein said actuator system is at least one of an external pneumatic actuator and an electro-mechanical linkage mechanism.

22. The washing cabinet of claim 1, wherein said actuator system is further configured to pulse said part being cleaned in at least one of said sonication tank and said spray chamber.

* * * * *